US007080537B2

(12) United States Patent
Tsuritani

(10) Patent No.: US 7,080,537 B2
(45) Date of Patent: Jul. 25, 2006

(54) SPRING MANUFACTURING MACHINE

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 326 days.

(21) Appl. No.: 10/454,619

(22) Filed: Jun. 5, 2003

(65) Prior Publication Data

US 2004/0194525 A1 Oct. 7, 2004

(30) Foreign Application Priority Data

Apr. 7, 2003 (JP) ..... 2003-102362

(51) Int. Cl.
*B21F 35/02* (2006.01)

(52) U.S. Cl. ..... 72/137; 72/138; 72/140; 72/145; 72/447; 72/449; 72/404

(58) Field of Classification Search ..... 72/135, 72/137, 138, 404, 447, 449; 140/102, 103, 140/102.5
See application file for complete search history.

(56) References Cited

U.S. PATENT DOCUMENTS 1,821,249 A * 9/1931 Wadsten ..... 72/476
5,105,641 A 4/1992 Veit
5,363,681 A * 11/1994 Speck et al. ..... 72/129
5,452,598 A * 9/1995 Cheng ..... 72/12.6
5,454,249 A * 10/1995 Kempf et al. ..... 72/130
5,660,067 A * 8/1997 Liao ..... 72/138
5,829,293 A * 11/1998 Cheng ..... 72/145
6,000,265 A * 12/1999 Itaya ..... 72/138
6,029,494 A 2/2000 Wu
6,062,054 A * 5/2000 Abiru et al. ..... 72/132
6,817,220 B1 * 11/2004 Liu ..... 72/137

* cited by examiner

*Primary Examiner*—Dmitry Suhol
(74) *Attorney, Agent, or Firm*—Rabin & Berdo, P.C.

(57) ABSTRACT

To efficiently manufacture springs having various kinds of shapes, a spring manufacturing machine is structured such as to bend a wire by two inner engagement projections (47) by adjusting a position of a position adjusting table (34), fitting a gap (46) to the wire fed out from a final wire guide (13) and temporarily stopping, and thereafter rotating a rotation spindle (48), and also to bend a wire on the basis of a cooperation of an outer engagement projection (44) and the inner engagement projection (47) by adjusting the position of the position adjusting table (34), fitting the gap (46) to the wire fed out from the final wire guide (13) and temporarily stopping, and thereafter rotating a rotation sleeve (45).

6 Claims, 6 Drawing Sheets

SPRING MANUFACTURING MACHINE

BACKGROUND OF THE INVENTION

1. Field of the Invention

The present invention relates to a spring manufacturing machine.

2. Description of the Conventional Art

The applicant of the present invention has already filed a patent application titled by "WIRE BENDING APPARATUS OF SPRING MANUFACTURING MACHINE" to Japanese Patent Office (refer to Japanese Patent Application No. 2001-247507).

The wire bending apparatus mentioned above is a wire bending apparatus for a spring manufacturing machine which feeds out a wire from a final wire guide to a wire working space, and applies a predetermined work to the wire fed out to the wire working space or going to be fed out, by a tool protruding to the wire working space or set in a protruding state, thereby manufacturing a spring, comprising:

a slide provided in a machine casing of the spring manufacturing machine so as to move forward and backward with respect to the wire working space in such a manner as to be positioned outside the wire working space;

a rotation spindle rotatably provided in the slide so that the axis is orthogonal to a center line of a wire passage in the final wire guide; and a rotation sleeve provided so as to freely rotate with respect to the rotation spindle, wherein at least a pair of inner engagement projections opposing to each other with a gap to which the wire is fitted are provided in an end portion of the rotation spindle in the side of the wire working space, the end portion of the rotation sleeve in the side of the wire working space is not collided and interfered with the wire fitted to the gap, and an outer engagement projection is provided in the end portion of the rotation sleeve in the side of the wire working space with a gap to which the wire is fitted, the gap being formed between the outer engagement projection and the rotation spindle.

The inventor of the present application has carried out further research and development for the purpose of manufacturing a spring manufacturing machine having a good usability by applying the wire bending apparatus to the spring manufacturing machine, and has brought the present invention to completion.

SUMMARY OF THE INVENTION

The present invention has the following structures.

(1) In accordance with a first aspect of the present invention, there is provided a spring manufacturing machine (1) comprising:

a wire working space (15) provided in front of a front wall (4) in a machine casing (2);

a final wire guide (13) guiding a wire fed out toward the wire working space (15) and provided in the front wall (4) so as to direct a wire passage to the back and forth direction;

a wire feeding unit (16) provided in the rear of the front wall (4);

a pair of right and left position adjusting tables (34) movably provided in the front face of the front wall (4); and wire working apparatuses (41) provided in these position adjusting tables (34), wherein the wire feeding unit (16) has a casing (17) having a wire penetrating opening passing through in the back and forth direction, and at least a pair of wire feeding rollers (24) rotatably provided in the casing (17) and feeding the wire toward the final wire guide (13) while clamping the wire, the right position adjusting table (34) has a first moving table (36) provided in the front wall (4) so as to freely move in the direction orthogonal to a right incline virtual line (L2) passing through the center line (C1) of the wire passage in the final wire guide (13) and being at an angle of 45 degrees with a vertical virtual line (L1) as seen from the front, and a second moving table (37) provided in the first moving table (36) so as to freely move in the direction orthogonal to the moving direction of the first moving table (36), the left position adjusting table (34) has a first moving table (36) provided in the front wall (4) so as to freely move in the direction orthogonal to a left incline virtual line (L2) passing through the center line (C1) of the wire passage in the final wire guide (13) and being at an angle of 45 degrees with the vertical virtual line (L1) as seen from the front, and a second moving table (37) provided in the first moving table (36) so as to freely move in the direction orthogonal to the moving direction of the first moving table (36), the wire working apparatus (41) has a tubular support body (42) provided in the second moving table (37) so that the axis (C2) is in parallel to the moving direction of the second moving table (37), a rotation sleeve (45) fitted to the tubular support body (42) so as to freely rotate forward and backward and having an outer engagement projection (44) engaged with the wire in an end portion in the side of the wire working space (15), a rotation spindle (48) fitted to the rotation sleeve (45) so as to freely rotate forward and backward, and having at least a pair of inner engagement projections (47) opposing to each other with a gap (46) to which the wire is fitted in an end portion in the side of the wire working space (15), and a bending die (49) provided in an end portion of the tubular support body (42) in the side of the wire working space (15), and having an incline groove (50) to which the wire is fitted, the bending die (49) is positioned in the side of the front wall (4) from the rotation sleeve (45), a leading end (49*a*) of the bending die (49) is disposed at a position further retreated from the wire working space (15) than the gap (46), the incline groove (50) of the bending die (49) is an incline groove directed to the front wall (4) and the wire working space (15), the incline groove (50) is formed parallel to the incline virtual line (L2) in a state of being seen from the front, and a gap (54) to which the wire is fitted is formed between the outer engagement projection (44) and the inner engagement projection (47).

(2) In accordance with a second aspect of the present invention, there is provided a spring manufacturing machine as recited in the first aspect, wherein the final wire guide (13) is structured such as to be rotatable around the center line (C1) of the wire passage, and the casing (17) of the wire feeding unit (16) is structured such as to be rotatable around the center line (C1) of the wire passage.

The present invention achieves the following effects on the basis of the structure mentioned above.

(1) In accordance with the first aspect of the present invention, it is possible to effectively manufacture springs having various kinds of shapes by bending a wire by means of two inner engagement projections, bending a wire in cooperation with the inner engagement projection and the outer engagement projection, forming a coil portion (a spring body) by means of the bending die, and selectively using two wire working apparatuses.

(2) In accordance with the second aspect of the present invention, it is possible to manufacture the springs having various kinds of shapes by changing the direction of the final wire guide to a direction which does not interfere the spring work, and rotating the wire feeding unit so as to rotate the wire clamped by the wire feeding rollers around the center line thereof.

DESCRIPTION OF THE PREFERRED EMBODIMENT

A description will be given below of an embodiment in accordance with the present invention.

Figure 1:
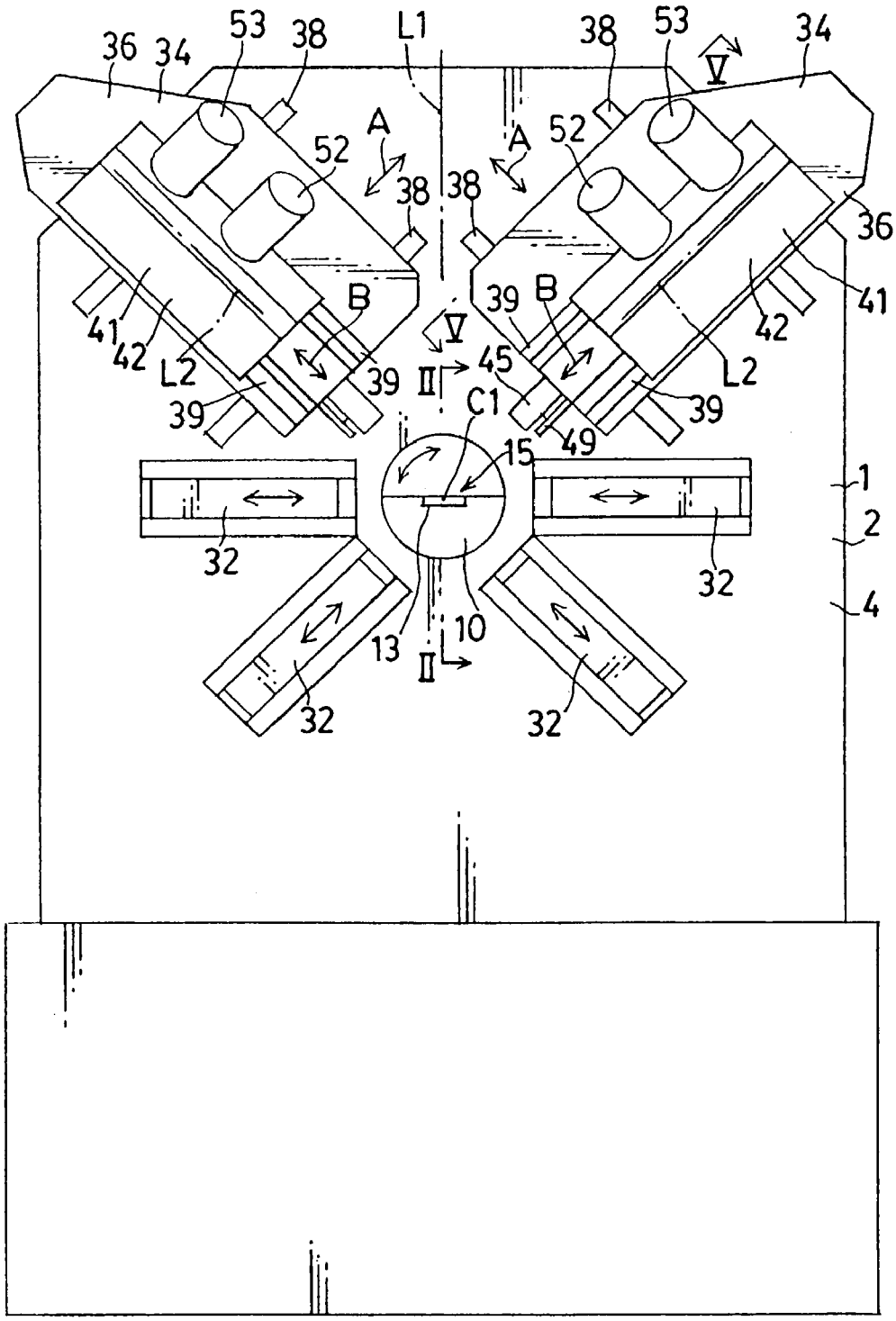
FIG. 1 is a simplified front view showing an embodiment in accordance with the present invention.

In this case, in this description, the term "front" means the front side of the paper of FIG. 1, the term "rear" means the back side, the term "left" means the left side in FIG. 1 and the term "right" means the right side in FIG. 1.

A machine casing 2 of a spring manufacturing machine 1 has a vertical front wall 4, and a vertical rear wall 5 positioned behind the front wall 4 with a predetermined interval. Circular holes 6 and 7 having a common horizontal axis and passing through in the back and forth direction are formed in the front wall 4 and the rear wall 5. The axial lines of these circular holes 6 and 7 form the common center line C1 of wire passages in a final wire guide 13 mentioned below and the like.

A rotation body 10 having a recess portion 11 open rearward and having a circular cross section is rotatably fitted to the circular hole 6 of the front wall 4 mentioned above, and the final wire guide 13 is mounted to a protruding portion in the front of the rotation body 10. The final wire guide 13 has a wire passage (not shown) in which the center line is aligned with the common center line C1.

An annular gear 14 is mounted to the rear end of the rotation body 10 mentioned above, and the gear 14 is structured such as to be directly or indirectly rotated by a gear fitted to a rotation shaft of a reversibly rotatable motor (not shown). In accordance with the structure mentioned above, it is possible to rotate the final wire guide 13 around the common center line C1.

A forward space of the front end of the final wire guide 13 is formed as a wire working space 15.

A rotation casing 17 of a wire feeding unit 16 is provided in the front wall 4 and the rear wall 5 so as to freely rotate around the common center line C1 by a means described in detail below.

The rotation casing 17 has a casing main body 18, a front tube body 20 provided in a front portion of the casing main body 18, and a rear tube body 21 provided in a rear portion of the casing main body 18 and having a wire passing opening. Further, the front tube body 20 is rotatably fitted to a recess portion 11 of the rotation body 10, and the rear tube body 21 is rotatably fitted to the circular hole 7 of the rear wall 5.

An annular gear 22 is mounted to the rear end of the rear tube body 21, and this gear 22 is structured such as to be directly or indirectly rotated by a gear fitted and fixed to a rotation shaft of a reversibly rotatable motor (not shown). In accordance with the structure mentioned above, it is possible to rotate the rotation casing 17 around the common center line C1.

Figure 2:
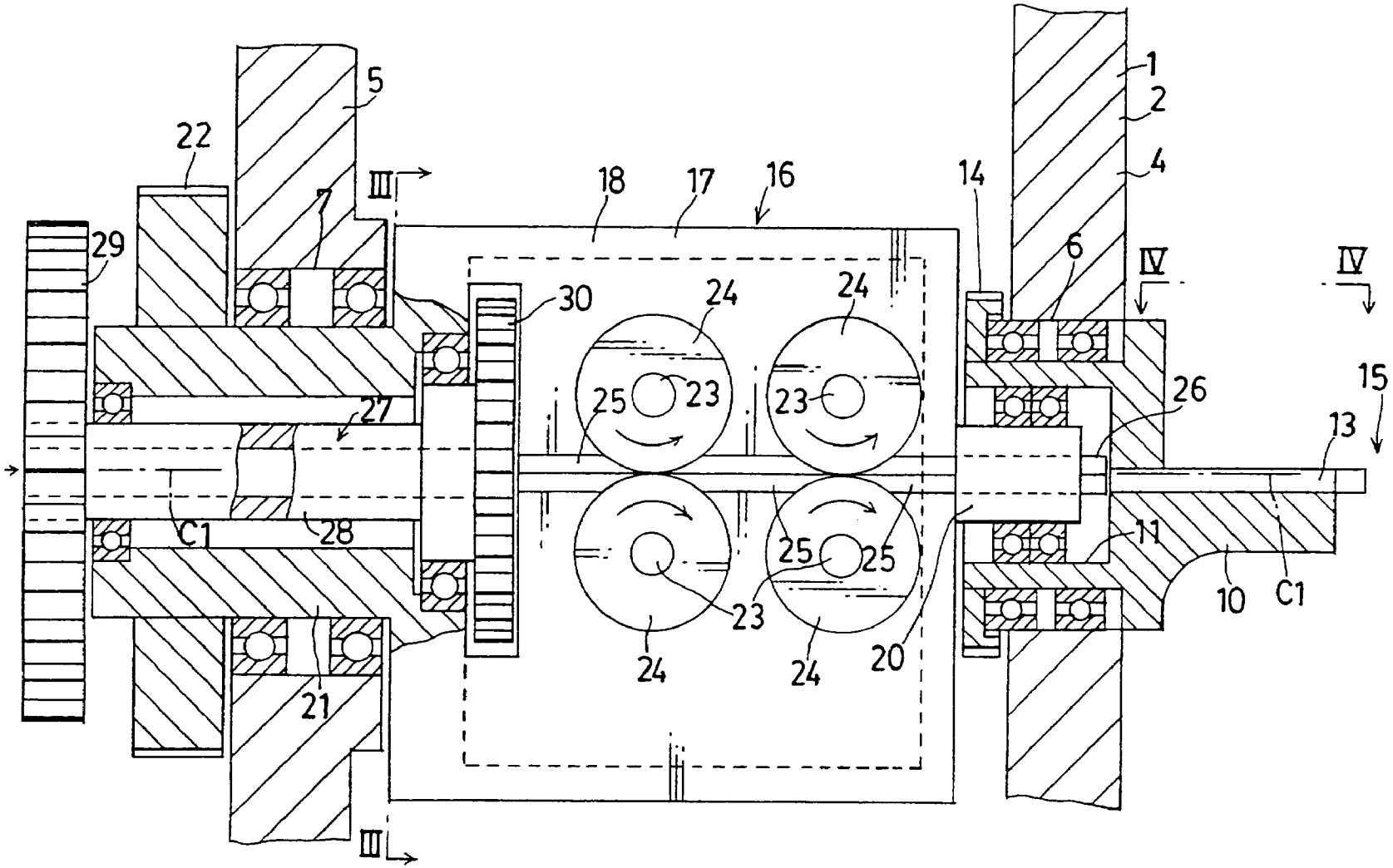
FIG. 2 is an enlarged cross sectional view along a line II—II in FIG. 1.
Figure 3:
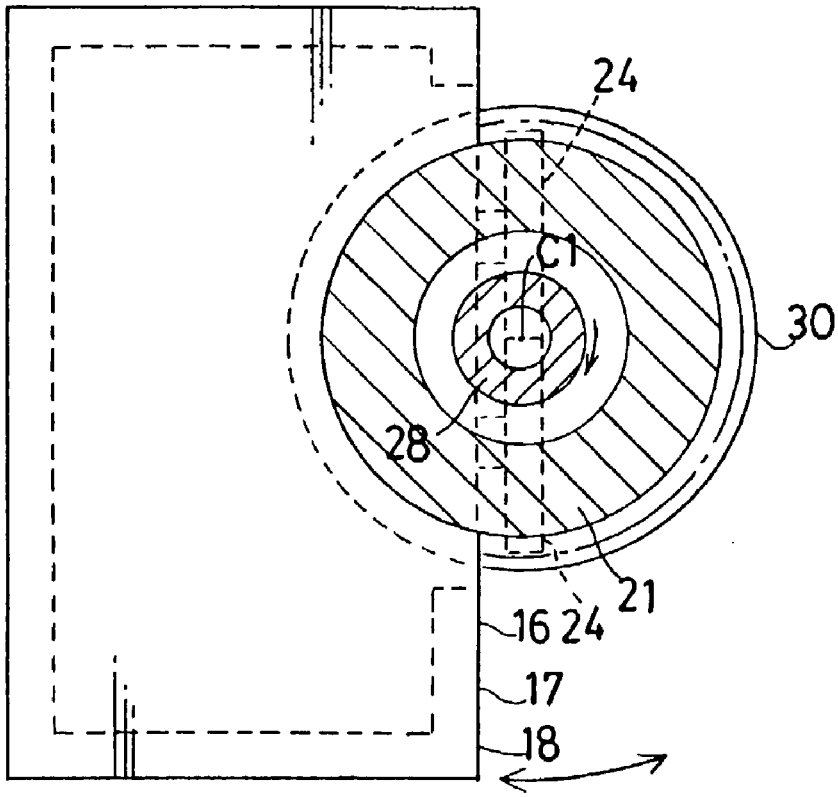
FIG. 3 is a cross sectional view along a line III—III in FIG. 2.
Figure 4:
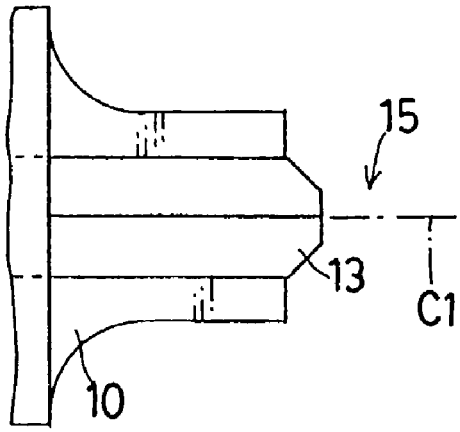
FIG. 4 is a cross sectional view along a line IV—IV in FIG. 2.
Figure 5:
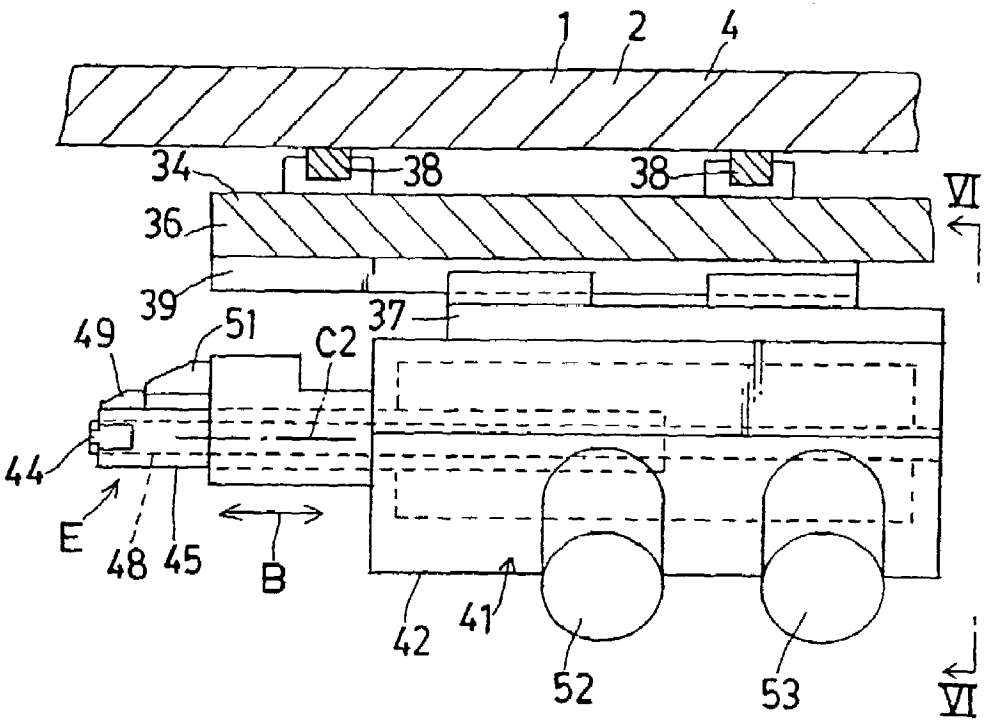
FIG. 5 is an enlarged cross sectional view along a line V—V in FIG. 1.
Figure 6:
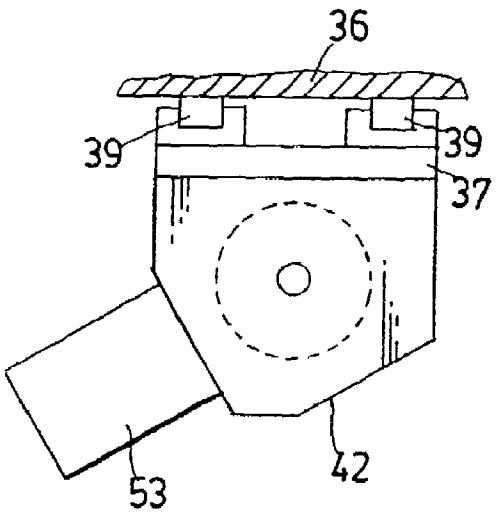
FIG. 6 is a cross sectional view along a line VI—VI in FIG. 5.

The rotation casing 17 rotates in the manner mentioned. The following description will be given of the rotation casing 17 in a state shown in FIG. 2. Pairs of upper and lower roller shafts 23 in which axes are directed to the right and left direction are rotatably provided in front and rear portions of the casing main body 18, and a wire feeding roller 24 having an annular wire groove (not shown) on the outer peripheral surface thereof is mounted to the left end protruding from the casing main body 18 in each of the roller shafts 23. The pair of the upper and lower wire feeding rollers 24 are structured such as to be brought into contact with each other. The wire passage having the center line aligned with the common center line C1 is formed by portions of the opposing upper and lower wire grooves (not shown). In accordance with the structure mentioned above, it is possible to feed out the wire (not shown) fitted to the wire groove to the front by rotating the lower wire feeding rollers 24 in the clockwise direction in FIG. 2 and rotating the upper wire feeding rollers 24 in the counterclockwise direction in FIG. 2 synchronously with the lower wire feeding rollers 24.

An auxiliary wire guide 25 having a wire passage (not shown) having the center line aligned with the common center line C1 is mounted to the casing main body 18.

An auxiliary wire guide 26 is mounted to the rotation body 10. The front end of the auxiliary wire guide 26 is connected to the final wire guide 13, and the rear end is connected to the headmost auxiliary wire guide 25. The center line of a wire passage (not shown) (a wire passing opening mentioned in claims) of the auxiliary wire guide 26 is structured such as to be aligned with the common center line C1.

The wire feeding roller 24 is structured such as to be rotated by a roller driving transmission apparatus 27.

The roller driving transmission apparatus 27 has a hollow shaft 28 rotatably fitted to the rear tube body 21 of the rotation casing 17, an annular prime drive gear 29 provided on the end (the rear end) of the hollow shaft 28 outside the rotation casing 17, an annular gear 30 provided of the hollow shaft 28 on the end of the hollow shaft 28 inside the rotation casing 17, and a plurality of transmission gears (not shown) (provided within the casing main body 18) transmitting rotation of the gear 30 to the roller shafts 23 of the wire feeding rollers 24.

A window for making the annular gear 30 to be exposed out of the casing main body 18 is formed in the casing main body 18.

The gear 29 is structured such as to be directly or indirectly rotated by the gear fitted and fixed to a rotation shaft of a reversibly rotatable motor (not shown). In accordance with the structure mentioned above, it is possible to rotate the hollow shaft 28 around the common center line C1 so as to rotate the wire feeding roller 24 in the manner mentioned above.

A desired number of well-known tool mounting slides 32 are provided in the front face of the front wall 4 so as to freely move forward and backward with respect to the wire working space 15. The tool mounting slides 32 are structured such as to be driven by a well-known drive apparatus (not shown). A cutter, a forming tool or the like is mounted to the tool mounting slides 32.

A right position adjusting table 34 is provided in an upper right portion of the front wall 4 (a right portion from a vertical virtual line L1 passing through the center line C1 of the wire passage in the final wire guide 13), in the manner described in detail below.

The right position adjusting table 34 has a first moving table 36 provided in the front wall 4 so as to freely move in a direction (refer to an arrow A in FIG. 1) orthogonal to a right incline virtual line L2 at an angle of 45 degrees as seen from the front with respect to the virtual line L1, and a second moving table 37 provided in the first moving table 36 so as to freely move in a direction (refer to an arrow B in FIG. 1) orthogonal to the moving direction of the first moving table 36. The first moving table 36 is structured such as to be moved along a pair of guide rails 38 provided in the front wall 4 to be orthogonal to the incline virtual line L2 and be moved by a well-known drive apparatus (not shown). Further, the second moving table 37 is structured such as to be moved along a pair of guide rails 39 provided in the first moving table 36 to be parallel to the right incline virtual line L2 and be moved by a well-known drive apparatus (not shown) (which is mounted on the first moving table 36).

A right wire working apparatus 41 is provided in the right second moving table 37 in the manner mentioned in detail below.

Figure 9:
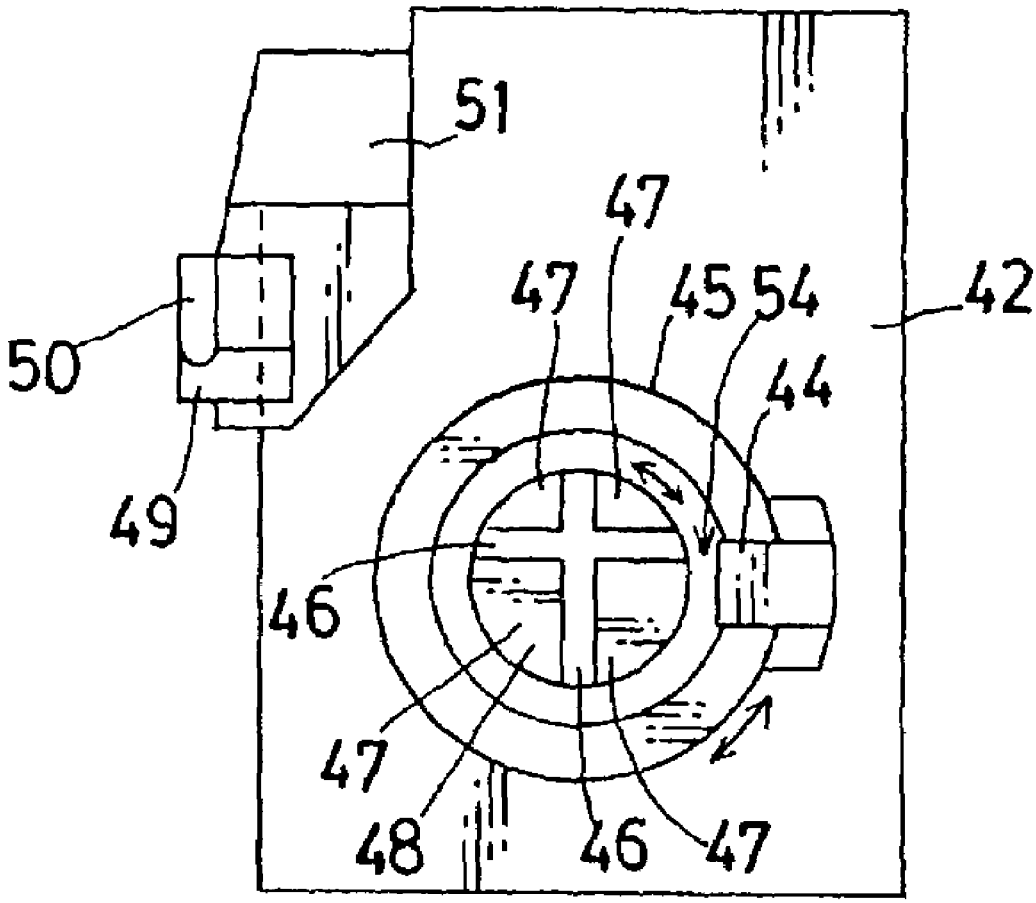
FIG. 9 is a cross sectional view along a line IX—IX in FIG. 7.

The wire working apparatus 41 has a tubular support body 42 provided in the second moving table 37 so that the axis C2 is in parallel to the moving direction (the incline virtual line L2) of the second moving table 37, a rotation sleeve 45 fitted to the tubular support body 42 so as to freely rotate forward and backward and having an outer engagement projection 44 engaged with the wire in an end portion in the side of the wire working space 15, a rotation spindle 48 fitted to the rotation sleeve 45 so as to freely rotate forward and backward, and having four inner engagement projections 47 (refer to FIG. 9) opposing to each other with a gap 46 to which the wire is fitted in an end portion in the side of the wire working space 15, and a bending die 49 provided in an end portion of the tubular support body 42 in the side of the wire working space 15, and having an incline groove 50 to which the wire is fitted. Further, a gap 54 (refer to FIG. 9) to which the wire is fitted is formed between the outer engagement projection 44 and the inner engagement projection 47.

The rotation sleeve 45 is structured such as to be rotatable with respect to the tubular support body 42 via a bearing (not shown), and the rotation spindle 48 is structured such as to be rotatable with respect to the rotation sleeve 45 and the tubular support body 42 via a bearing (not shown). Further, the rotation sleeve 45 is structured such as to be rotated by a reversibly rotatable motor 52 provided in the tubular support body 42. Further, the rotation spindle 48 is rotated by a reversibly rotatable motor 53 provided in the tubular support body 42.

The bending die 49 is particularly mounted to the tubular support body 42 via a holder 51 so as to be freely adjusted in back and forth positions. The bending die 49 is positioned in the side of the front wall 4 from the rotation sleeve 45. Further, the leading end 49*a* of the bending die 49 is disposed at a position further retreated from the wire working space 15 than the gap 46. In accordance with this structure, the bending die 49 is structured such as to be prevented from colliding and interfering with the fitted wire.

Figure 7:
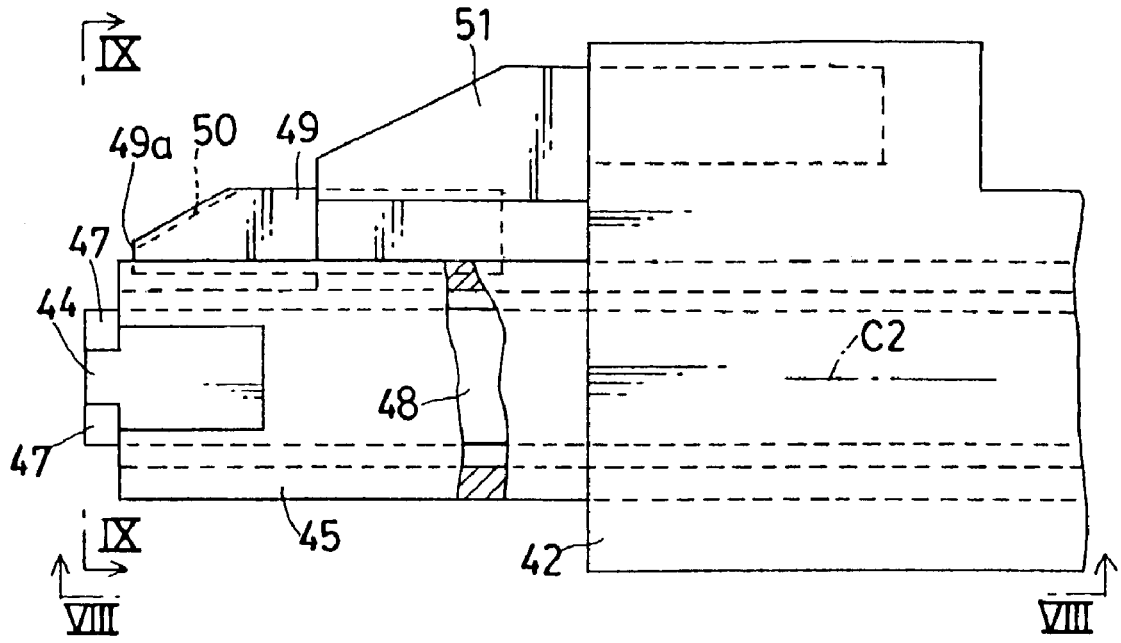
FIG. 7 is an enlarged view of a portion E in FIG. 5.
Figure 8:
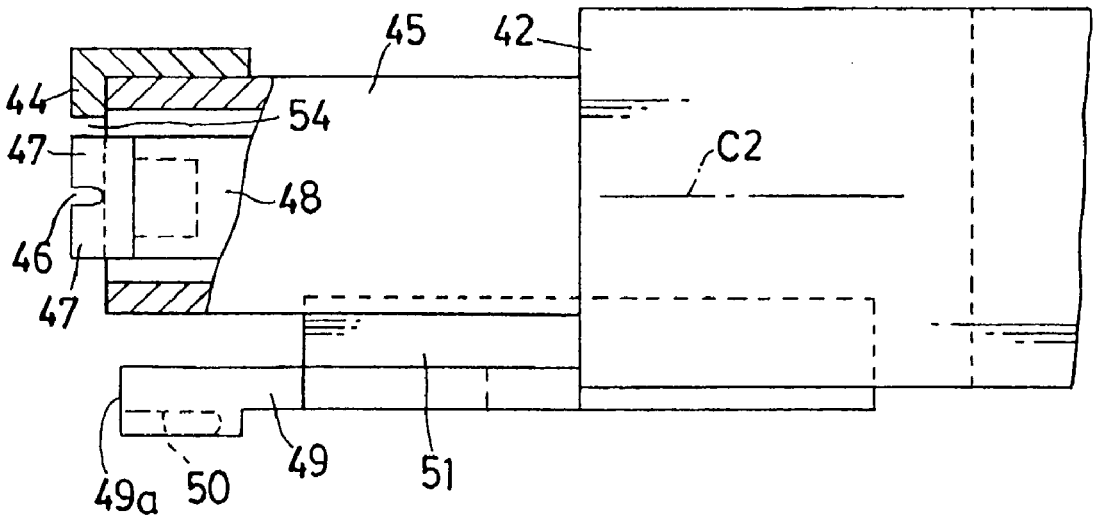
FIG. 8 is a cross sectional view along a line VIII—VIII in FIG. 7.

The incline groove 50 of the bending die 49 is an incline groove directed to the front wall 4 and the wire working space 15 (refer to FIG. 7). Further, the incline groove 50 is formed parallel to the incline virtual line L2 in a state of being seen from a front face (in a state shown in FIG. 1).

The left position adjusting table 34 and the left wire working apparatus 41 provided in the left position adjusting table 34 are provided in an upper left portion of the front wall 4 (a left portion from the vertical virtual line L1 passing through the center line C1). The left position adjusting table 34 and the left wire working apparatus 41 have the same shape as an image obtained in the case that the right position adjusting table 34 and the right wire working apparatus 41 are reflected in a mirror placed in the virtual line L1 so as to direct a mirror face to the right. Further, the structures of the left position adjusting table 34 and the left wire working apparatus 41 are the same as the right position adjusting table 34 and the right wire working apparatus 41. Therefore, a detailed description of the left position adjusting table 34 and the left wire working apparatus 41 is omitted.

In accordance with the structure mentioned above, it is possible to achieve the following wire work.

(1) It is possible to bend the wire by two inner engagement projections 47 by adjusting the position of the position adjusting table 34, fitting the gap 46 to the wire fed out from the final wire guide 13 and temporarily stopping, and thereafter rotating the rotation spindle 48.

(2) It is possible to bend the wire on the basis of the cooperation of the outer engagement projection 44 and the inner engagement projection 47 by adjusting the position of the position adjusting table 34, fitting the gap 46 to the wire fed out from the final wire guide 13 and temporarily stopping, and thereafter rotating the rotation sleeve 45.

(3) It is possible to sequentially bend the wire so as to form the coil portion (the spring body) by adjusting the position of the position adjusting table 34, applying the incline groove 50 of the bending die 49 to the wire fed out from the final wire guide 13 (protruding the bending die 49 toward the wire working space 15), thereafter stopping the bending die 49 at this position and going on with feeding out the wire.

At the time of carrying out the work mentioned above, the final wire guide 13 is rotated and moved to a desired position so as not to interfere working of the wire. Further, it is possible to change the direction of semi-finished article protruding from the final wire guide 13 by rotating the rotation casing 17 so as to rotate the wire around the axis thereof.

The other operations of the spring manufacturing machine 1 are the same as the operations of the conventional spring manufacturing machine.

A description will be additionally given below of modified embodiments.

(1) It is sufficient that at least a pair of wire feeding rollers 24 are provided.

(2) The rotation casing 17 may be replaced by a non-rotation one.

(3) A shape of the inner engagement projection is not particular. Further, it is sufficient that least two inner engagement projections 47 are provided.

What is claimed is:

1. A spring manufacturing machine (1) comprising:

a wire working space (15) provided in front of a front wall (4) in a machine casing (2);

a final wire guide (13) guiding a wire fed out toward the wire working space (15) and provided in the front wall (4) so as to direct a wire passage to the back and forth direction;

a wire feeding unit (16) provided in the rear of the front wall (4);

a pair of right and left position adjusting tables (34) movably provided in the front face of the front wall (4); and wire working apparatuses (41) provided in these position adjusting tables (34), wherein said wire feeding unit (16) has a casing (17) having a wire penetrating opening passing through in the back and forth direction, and at least a pair of wire feeding rollers (24) rotatably provided in the casing (17) and feeding the wire toward the final wire guide (13) while clamping the wire, said right position adjusting table (34) has a first moving table (36) provided in the front wall (4) so as to freely move in the direction orthogonal to a right incline virtual line (L2), the right incline virtual line being at an angle of 45 degrees as seen from the front with a vertical virtual line (L1), and passing through the center line (C1) of the wire passage in the final wire guide (13), the right incline virtual line (L2) being perpendicular to the center line (C1) of the wire passage in the final wire guide (13), and a second moving table (37) provided in the first moving table so as to freely move in the direction orthogonal to the moving direction of the first moving table (36), said left position adjusting table (34) has a first moving table (36) provided in the front wall (4) so as to freely move in the direction orthogonal to a left incline virtual line (L2), the left incline virtual line being at an angle of 45 degrees as seen from the front with a vertical virtual line (L1), and passing through the center line (C1) of the wire passage in the final wire guide (13), the left incline virtual line (L2) being perpendicular to the center line (C1) of the wire passage in the final wire guide (13), and a second moving table (37) provided in the first moving table so as to freely move in the direction orthogonal to the moving direction of the first moving table (36), said wire working apparatus (41) has a tubular support body (42) provided in said second moving table (37) so that an axis (C2) is in parallel to the moving direction of the second moving table (37), a rotation sleeve (45) fitted to the tubular support body (42) so as to freely rotate forward and backward and having an outer engagement projection (44) engaged with the wire in an end portion in the side of the wire working space (15), a rotation spindle (48) fitted to the rotation sleeve (45) so as to freely rotate forward and backward, and having at least a pair of inner engagement projections (47) opposing to each other with a gap (46) to which the wire is fitted in an end portion in the side of the wire working space (15), and a bending die (49) mounted to an end portion of the tubular support body (42) in the side of the wire working space (15), and having an incline groove (50) to which the wire is fitted, said bending die (49) is positioned toward the front wall (4) from the rotation sleeve (45), a leading end (49*a*) of said bending die (49) is disposed at a position further retreated from the wire working space (15) than the gap (46), the incline groove (50) of the bending die (49) is an incline groove directed to the front wall (4) and the wire working space (15), the incline groove (50) is formed parallel to the incline virtual line (L2) in a state of being seen from the front, and a gap (54) to which the wire is fitted is formed between the outer engagement projection (44) and the inner engagement projection (47).

2. A spring manufacturing machine as claimed in claim 1, wherein said final wire guide (13) is structured such as to be rotatable around the center line (C1) of the wire passage, and the casing (17) of the wire feeding unit (16) is structured such as to be rotatable around the center line (C1) of the wire passage.

3. A spring manufacturing machine (1) comprising:

a wire working space (15) provided in front of a front wall (4) in a machine casing (2);

a final wire guide (13) guiding a wire fed out toward the wire working space (15) and provided in the front wall (4) so as to direct a wire passage to the back and forth direction;

a wire feeding unit (16) provided in the rear of the front wall (4);

at least one position adjusting table (34) movably provided in the front face of the front wall (4); and at least one wire working apparatus (41) provided in the position adjusting table (34);

a bending die (49) having an incline groove (50) to which the wire fitted;

wherein said wire feeding unit (16) has a casing (17) having a wire penetrating opening passing through in the back and forth direction, and at least a pair of wire feeding rollers (24) rotatably provided in the casing (17) and feeding the wire toward the final wire guide (13) while clamping the wire;

said at least one position adjusting table (34) has a first moving table (36) provided in the front wall (4) so as to freely move in the direction orthogonal to a virtual line (L2) which is perpendicular to the center line (C1) of the wire passage in the final wire guide (13), and a second moving table (37) provided in the first moving table so as to freely move in the direction orthogonal to the moving direction of the first moving table (36), said wire working apparatus (41) has a tubular support body (42) provided in said second moving table (37) so that an axis (C2) is in parallel to the moving direction of the second moving table (37), a rotation sleeve (45) fitted to the tubular support body (42) so as to freely rotate forward and backward and having an outer engagement projection (44) engaged with the wire in an end portion in the side of the wire working space (15), a rotation spindle (48) fitted to the rotation sleeve (45) so as to freely rotate forward and backward, and having at least a pair of inner engagement projections (47) opposing to each other with a gap (46) to which the wire is fitted in an end portion in the side of the wire working space (15), said bending die (49) being mounted to an end portion of the tubular support body (42) in the side of the wire working space (15), said bending die (49) being positioned toward the front wall (4) from the rotation sleeve (45), a leading end (49*a*) of said bending die (49) being disposed at a position further retreated from the wire working space (15) than the gap (46), the incline groove (50) of the bending die (49) being an incline groove directed to the front wall (4) and the wire working space (15), the incline groove (50) being formed parallel to the virtual line (L2) in a state of being seen from the front, and a gap (54) to which the wire is fitted being formed between the outer engagement projection (44) and the inner engagement projection (47).

4. A spring manufacturing machine according to claim 3, wherein said final wire guide (13) is structured such as to be rotatable around the center line (C1) of the wire passage, and the casing (17) of the wire feeding unit (16) is structured such as to be rotatable around the center line (C1) of the wire passage.

5. A spring manufacturing machine according to claim 3, wherein said final wire guide (13) is structured such as to be rotatable around the center line (C1) of the wire passage, and the casing (17) of the wire feeding unit (16) is structured such as to be rotatable around the center line (C1) of the wire passage.

6. A spring manufacturing machine according to claim 3, wherein said final wire guide (13) is structured such as to be rotatable around the center line (C1) of the wire passage, and the casing (17) of the wire feeding unit (16) is structured such as to be rotatable around the center line (C1) of the wire passage.

* * * * *